US008207477B2

(12) United States Patent
Embury et al.

(10) Patent No.: US 8,207,477 B2
(45) Date of Patent: Jun. 26, 2012

(54) METHOD FOR COOKING VEGETABLES USING STEAM

(75) Inventors: Karen M. Embury, St. Joseph, MI (US); Joel M. Sells, Coloma, MI (US); Jason R. Savage, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1135 days.

(21) Appl. No.: 11/945,220

(22) Filed: Nov. 26, 2007

(65) Prior Publication Data

US 2009/0133684 A1 May 28, 2009

(51) Int. Cl.
*H05B 1/02* (2006.01)

(52) U.S. Cl. ..... 219/494; 219/497; 219/413

(58) Field of Classification Search ..... 219/494, 219/497, 499, 501, 505, 483–487, 412–415
See application file for complete search history.

(56) References Cited

U.S. PATENT DOCUMENTS

| | | | |
|---|---|---|---|
| 213,029 | A | 3/1879 | Ashcroft |
| 339,228 | A | 4/1886 | Smith |
| 1,332,216 | A | 3/1920 | Hodge et al. |
| 1,544,481 | A | 6/1925 | Reese |
| 1,792,465 | A | 2/1931 | Petersen |
| 1,870,459 | A | 8/1932 | Klenk |
| 2,141,591 | A | 12/1938 | Bonner |
| 2,502,172 | A | 3/1950 | Paulsen |
| 2,636,969 | A | 4/1953 | Lewis |
| 2,885,194 | A | 5/1959 | Winkler |
| 3,299,800 | A | 1/1967 | Angelo |
| 3,331,943 | A | 7/1967 | Eff |
| 3,364,338 | A | 1/1968 | Holtkamp |
| 3,394,665 | A | 7/1968 | Williams |
| 3,503,760 | A | 3/1970 | Allen |
| 3,518,949 | A | 7/1970 | Stock |
| 3,732,396 | A | 5/1973 | Tucker |
| 3,751,632 | A | 8/1973 | Kauranen |
| 3,814,901 | A | 6/1974 | Morhack |
| 3,820,524 | A | 6/1974 | Buckell |
| 3,839,616 | A | 10/1974 | Risman |
| 3,873,363 | A | 3/1975 | Bakka et al. |
| 3,947,241 | A | 3/1976 | Caridis et al. |
| 4,011,805 | A | 3/1977 | Vegh et al. |
| 4,058,635 | A | 11/1977 | Durth |
| 4,245,148 | A | 1/1981 | Gisske et al. |
| 4,258,731 | A | 3/1981 | Tsujimoto et al. |
| 4,267,976 | A | 5/1981 | Chatwin |
| 4,367,724 | A | 1/1983 | Willett |
| 4,426,923 | A | 1/1984 | Ohata |

(Continued)

FOREIGN PATENT DOCUMENTS

| | | | |
|---|---|---|---|
| BR | PI0601034 | A | 12/2006 |

(Continued)

OTHER PUBLICATIONS

European Search Report for EP1724529.

(Continued)

*Primary Examiner* — Mark Paschall
(74) *Attorney, Agent, or Firm* — Kirk W. Goodwin; McGarry Bair, PC

(57) ABSTRACT

A method of operating a household oven to cook vegetables using steam during a cooking cycle.

18 Claims, 9 Drawing Sheets

U.S. PATENT DOCUMENTS 4,623,780 A 11/1986 Shelton
4,655,192 A 4/1987 Jovanovic
4,700,685 A 10/1987 Miller
4,724,824 A 2/1988 McCoy et al.
4,737,373 A 4/1988 Forney
4,817,582 A 4/1989 Oslin et al.
4,835,368 A 5/1989 Fortmann et al.
4,876,426 A 10/1989 Smith
4,906,485 A 3/1990 Kirchhoff
4,913,039 A 4/1990 Sutphen
4,920,948 A 5/1990 Koether et al.
4,924,071 A 5/1990 Jacobs
4,924,072 A 5/1990 Oslin
4,991,545 A 2/1991 Rabe et al.
5,014,679 A 5/1991 Childs et al.
5,075,120 A 12/1991 Leary et al.
5,077,065 A 12/1991 Ash et al.
5,171,974 A 12/1992 Koether et al.
5,176,856 A 1/1993 Takahashi et al.
5,200,225 A 4/1993 Apaydin
5,209,941 A 5/1993 Wuest
5,215,000 A 6/1993 Desage et al.
5,235,902 A 8/1993 Ogawa et al.
5,279,676 A 1/1994 Oslin et al.
5,318,792 A 6/1994 Tippmann
5,330,223 A 7/1994 Hiramitsu et al.
5,355,840 A 10/1994 Violi
5,367,145 A 11/1994 Takagi
5,369,252 A 11/1994 Kondo
5,411,753 A 5/1995 Tippmann
5,463,940 A 11/1995 Cataldo
5,474,789 A 12/1995 Hayami et al.
5,494,690 A 2/1996 Shelton
5,512,312 A 4/1996 Forney et al.
5,515,773 A 5/1996 Bullard
5,525,782 A 6/1996 Yoneno et al.
5,532,456 A 7/1996 Smith et al.
5,549,038 A 8/1996 Kolvites
5,552,578 A 9/1996 Violi
5,619,983 A 4/1997 Smith
5,631,033 A 5/1997 Kolvites
5,640,946 A 6/1997 Oslin
5,662,959 A 9/1997 Tippmann
5,680,810 A 10/1997 Sham
5,694,835 A 12/1997 Mangina
5,710,409 A 1/1998 Schwarzbacker et al.
5,756,970 A 5/1998 Barger et al.
5,768,982 A 6/1998 Violi et al.
5,938,959 A 8/1999 Wang
5,942,142 A 8/1999 Forney et al.
5,945,018 A 8/1999 Halen
5,967,020 A 10/1999 Soyama et al.
6,023,050 A 2/2000 Violi
6,035,763 A 3/2000 Yung
6,040,564 A * 3/2000 Ueda et al. ..... 219/682
6,133,558 A 10/2000 Ueda et al.
6,175,100 B1 1/2001 Creamer et al.
6,188,045 B1 2/2001 Hansen et al.
6,202,637 B1 3/2001 Roberts
6,267,045 B1 7/2001 Wiedemann et al.
6,318,246 B2 11/2001 Fukushima et al.
6,323,464 B1 11/2001 Cohn
6,323,467 B1 11/2001 Alsafadi
6,342,262 B1 1/2002 Wuest
6,453,802 B1 9/2002 Manganiello et al.
6,465,762 B1 10/2002 Swayne et al.
6,497,907 B2 12/2002 Hofer
6,521,871 B1 2/2003 Shelton
6,545,251 B2 4/2003 Allera et al.
6,570,136 B1 5/2003 Lockwood et al.
6,572,911 B1 6/2003 Corcoran et al.
6,666,086 B2 12/2003 Colman et al.
6,727,478 B2 4/2004 Rael et al.
6,743,454 B1 6/2004 Gibson et al.
6,773,738 B2 8/2004 Berger et al.
6,815,644 B1 11/2004 Muegge et al.
6,833,032 B1 12/2004 Douglas et al.
6,900,414 B2 5/2005 Fisher
6,909,070 B2 6/2005 Veltrop et al.
6,909,071 B2 6/2005 Shozo
7,060,941 B1 * 6/2006 Embury et al. ..... 219/401
7,091,454 B2 8/2006 Cho et al.
7,113,695 B2 9/2006 Ono
7,199,340 B2 4/2007 Yamasaki et al.
7,208,701 B2 * 4/2007 Fraccon et al. ..... 219/401
7,235,762 B2 6/2007 Gagas et al.
7,537,004 B2 5/2009 Reay
7,745,763 B2 6/2010 Fraccon et al.
7,867,534 B2 1/2011 Sells et al.
2001/0051202 A1 12/2001 Hofer
2002/0179588 A1 12/2002 Lubrina et al.
2003/0132312 A1 7/2003 Kelly
2004/0022909 A1 2/2004 Holm et al.
2004/0226934 A1 11/2004 Moore, Jr. et al.
2004/0232141 A1 11/2004 Yamasaki et al.
2004/0256482 A1 12/2004 Linden
2004/0261632 A1 12/2004 Hansen et al.
2005/0034718 A1 2/2005 Van Over
2005/0051036 A1 3/2005 Erdmann et al.
2006/0000821 A1 1/2006 Gerola et al.
2006/0249136 A1 11/2006 Reay
2006/0249137 A1 11/2006 Reay
2006/0251784 A1 11/2006 Sells et al.
2006/0251785 A1 11/2006 Fraccon et al.
2006/0289438 A1 12/2006 Fraccon et al.
2007/0062927 A1 3/2007 Sells et al.
2007/0104844 A1 5/2007 Fraccon et al.
2007/0138160 A1 6/2007 Ando et al.
2008/0032018 A1 2/2008 Garniss et al.
2008/0095905 A1 4/2008 Sells et al.
2009/0136640 A1 5/2009 Embury et al.
2010/0178395 A1 7/2010 Embury et al.
2011/0068093 A1 3/2011 Sells et al.

FOREIGN PATENT DOCUMENTS

BR PI0601041 A 12/2006
BR PI0601130 A 12/2006
BR PI0601196 A 12/2006
BR PI0601213 A 12/2006
BR PI0601334 A 12/2006
BR PI0601214 A 3/2007
BR PI0601331 A 8/2007
CA 2524764 A1 10/2006
CA 2524583 A1 11/2006
CA 2524597 A1 11/2006
CA 2524757 A1 11/2006
CA 2524763 A1 11/2006
CA 2524766 A1 11/2006
CA 2524604 A1 1/2007
CA 2534521 A1 3/2007
CN 1928426 A 3/2007
DE 3909283 10/1990
DE 4303656 A1 8/1994
DE 19741881 3/1999
DE 19741881 A1 3/1999
DE 10335295 3/2005
EP 0233535 8/1987
EP 0277337 A2 8/1988
EP 0517681 A2 12/1992
EP 0643923 3/1995
EP 0768055 4/1997
EP 0893084 1/1999
EP 0894460 2/1999
EP 1010384 6/2000
EP 1166694 1/2002
EP 1372358 A1 12/2003
EP 1382280 A1 1/2004
EP 1714555 A2 10/2006
EP 1719414 A2 11/2006
EP 1719415 A 11/2006
EP 1719417 A2 11/2006
EP 1724529 A1 11/2006
EP 1724530 A1 11/2006
EP 1744104 A1 1/2007
EP 1761111 A2 3/2007
FR 2589678 A1 5/1987
FR 2652234 3/1991

| | | | |
|---|---|---|---|
| FR | 2840392 | | 12/2003 |
| GB | 190915098 | | 0/1910 |
| GB | 2373714 | | 10/2002 |
| GB | 2400298 | | 10/2004 |
| GB | 2400298 | A1 | 10/2004 |
| JP | 55068249 | | 5/1980 |
| JP | 57077829 | | 5/1982 |
| JP | 6014756 | | 1/1994 |
| JP | 8038134 | | 2/1996 |
| JP | 90044856 | | 1/1997 |
| JP | 2000093341 | | 4/2000 |
| JP | 2001346549 | | 12/2002 |
| KR | 2002006215 | A | 1/2002 |
| KR | 20060110746 | A | 10/2006 |
| KR | 20060115327 | A | 11/2006 |
| KR | 20060115329 | A | 11/2006 |
| KR | 20060115332 | A | 11/2006 |
| KR | 20060115333 | A | 11/2006 |
| KR | 20060115579 | A | 11/2006 |
| KR | 20070007701 | A | 1/2007 |
| KR | 20070027429 | A | 3/2007 |
| MX | PA05013410 | A | 1/2007 |
| MX | PA06003631 | A | 3/2007 |
| SU | 500788 | A1 | 1/1976 |
| WO | 9534220 | | 12/1995 |
| WO | 9734491 | | 9/1997 |
| WO | 9852418 | A1 | 11/1998 |
| WO | 9933347 | A1 | 7/1999 |
| WO | 9953767 | A1 | 10/1999 |
| WO | 03023285 | A2 | 3/2003 |

OTHER PUBLICATIONS

European Search Report for EP1744104.
European Search Report for EP1761111.
European Search Report for EP1719414.
European Search Report for EP1724530.

* cited by examiner

| Stage | Time (minutes) | Temperature (°F) | Upper Heating Element Duty Cycle | Lower Heating Element Duty Cycle | Convection Fan | Boiler Duty Cycle |
|---|---|---|---|---|---|---|
| 1 | 4 | 212 | 65 | 100 | On | 0 |
| 2 | 6 | 250 | 35 | 65 | On | 80 |
| 3 | 6 | Set temperature | 35 | 65 | On | 80 |
| 4 | Variable | Set temperature | 35 | 65 | On | 80 |

Fig. 6

| Stage | Time (minutes) | Temperature (°F) | Upper Heating Element Duty Cycle | Lower Heating Element Duty Cycle | Convection Fan | Boiler Duty Cycle |
|---|---|---|---|---|---|---|
| 1 | 4 | 212 | 65 | 100 | On | 0 |
| 2 | 6 | 250 | 35 | 65 | On | 100 |
| 3 | 6 | Set temperature | 35 | 65 | On | 100 |

Fig. 9

METHOD FOR COOKING VEGETABLES USING STEAM

BACKGROUND OF THE INVENTION

The benefits of cooking food, including vegetables, with steam include accelerating the cooking process, moisturizing the food during the cooking process, and preserving flavor, vitamins, and nutrients. Additionally, cooking with steam results in a more homogeneously cooked food item having an appearance that appeals to the senses.

Vegetables can be cooked in a number of ways, two of the most common being through steaming or roasting. Consumers currently steam vegetables on the cooktop or in the microwave using special containers required for steaming. Due to the limited capacity of cooktops, it is difficult to steam large amounts of vegetables at one time. Microwaves can unevenly heat the vegetables, resulting in uneven cooking. The consumer must also be careful of the steam escaping from the container.

Roasted vegetables are currently prepared in an oven to achieve some browning of the vegetables. During the browning process, also known as the Maillard reaction, reducing sugars and amino acids react at temperatures usually in the range of about 300-500° F. and break down relatively large, dull tasting molecules into relatively small, volatile molecules having a pleasing taste and odor. Thus, the browning process gives the vegetables a desired flavor in addition to changing the color of the surface of the vegetables. Browning occurs only at the surface because the moisture in the vegetables prevents the interior from reaching temperatures required for the Maillard reactions to take place. The browning Maillard reaction, however, cannot occur at the surface of the vegetables in an overly humid cooking cavity. As a result, vegetables are typically roasted without the addition of moisture, which often results in over-drying or burning of the vegetables if the consumer is not watchful.

Over the years, cooks have developed various kinds of home remedies for steaming vegetables in an oven such as inserting a bath of water and/or ice cubes into the cooking cavity, for providing steam into the cooking cavity. For convenience and to eliminate problems with consistency and timing of steam introduction associated with these home remedies, some contemporary household ovens incorporate an automated steam generating system that introduces steam into the cooking cavity of the oven.

Many of these ovens rely on the consumer for controlling the activation and operation of the steam generating system which leads to inconsistent results. It would be helpful to the user for ovens to include automated programs dedicated to steaming and roasting vegetables to ensure that appropriate amounts of steam are introduced into the cooking cavity at appropriate times during the cooking cycle so that the vegetables are properly cooked and that the benefits of cooking with steam are fully realized.

SUMMARY OF THE INVENTION

According to an aspect of the invention, a method of operating an oven with a cooking cavity during a cooking cycle using steam, a heating system for heating the cooking cavity, and a steam system for introducing steam into the cooking cavity comprises a first heating step comprising preheating the cooking cavity to a first temperature. The method also comprises a second heating step comprising preheating the cooking cavity from the first temperature to a second temperature, third heating step of heating the cooking cavity to a cooking temperature and operating a steam system at a given duty cycle to introduce steam into the cooking cavity during the second heating step to increase a relative humidity in the cooking cavity to a predetermined level. The method also comprises maintaining the cooking cavity at the cooking temperature while operating the steam system at the given duty cycle to maintain the relative humidity at the predetermined level until completion of the cooking cycle.

BRIEF DESCRIPTION OF THE DRAWINGS

In the drawings:

FIG. 6 is a table of exemplary parameters for implementation of the method of roasting vegetables shown in FIGS. 4 and 5.

FIG. 9 is a table of exemplary parameters for implementation of the method of steaming vegetables shown in FIGS. 7 and 8.

DESCRIPTION OF THE PREFERRED EMBODIMENT

Figure 1:
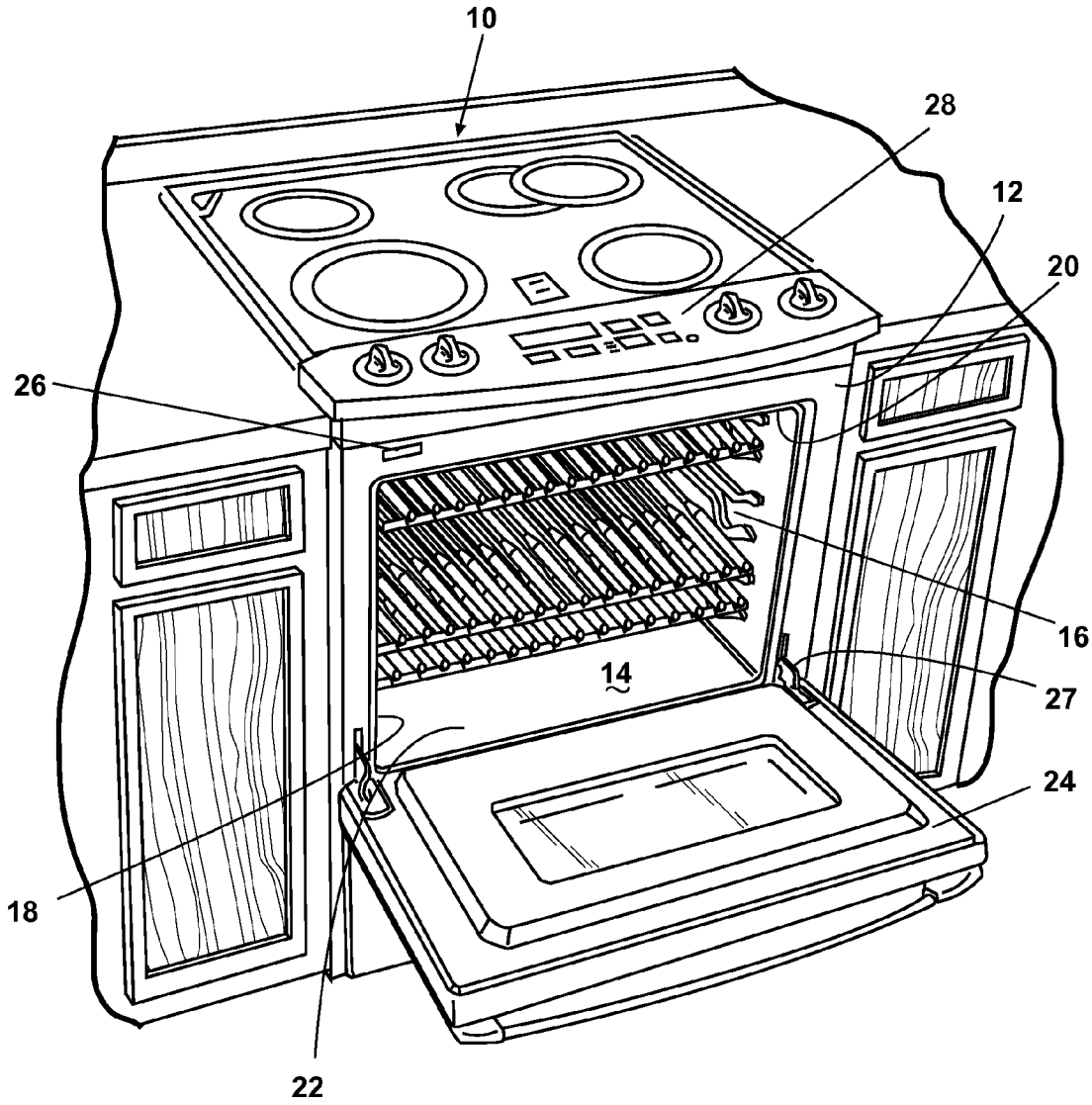
FIG. 1 is a perspective view of an exemplary automatic household oven.
Figure 2:
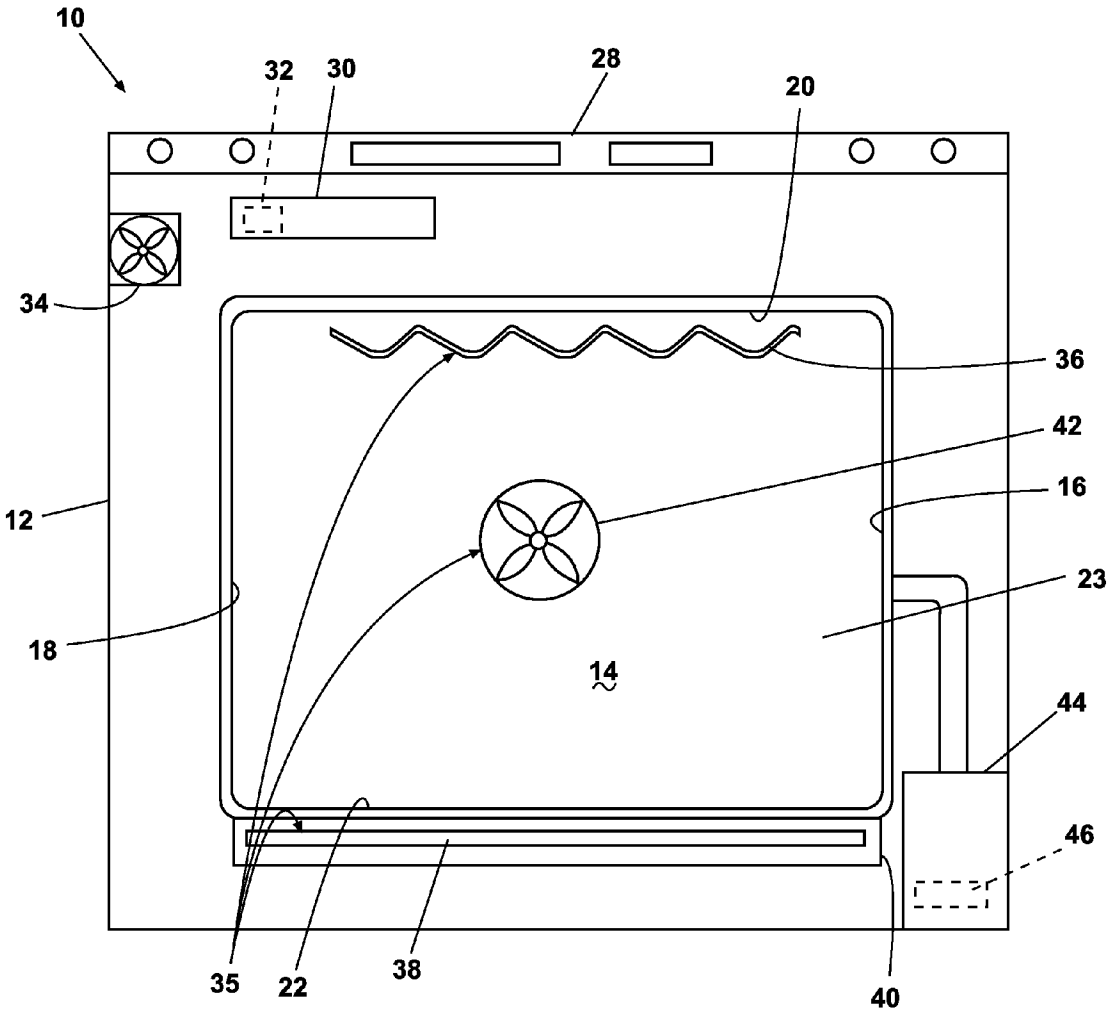
FIG. 2 is a schematic view of the oven of FIG. 1.

Referring now to the figures, FIG. 1 illustrates an exemplary automatic household oven 10 that can be used to implement methods for cooking vegetables with steam according to one embodiment of the invention. The oven 10 comprises a cabinet 12 with an open-face cooking cavity 14 defined by cooking cavity walls: a pair of spaced side walls 16, 18 joined by a top wall 20, a bottom wall 22, and a rear wall 23 (FIG. 2). A door 24 pivotable at a hinge 27 selectively closes the cavity 14, and a sensor 26 detects an open position of the door 24 and a closed position of the door 24. When the door 24 is in the open position, a user can access the cavity 14, while the door 24 in the closed position prevents access to the cavity 14 and seals the cavity 14 from the external environment.

The oven 10 further comprises a control panel 28 accessible to the user for inputting desired cooking parameters, such as temperature and time, of manual cooking programs or for selecting automated cooking programs. The control panel 28 communicates with a controller 30 located in the cabinet 12, as shown in FIG. 2. The controller 30 can be a proportional-integral-derivative (PID) controller or any other suitable controller, as is well-known in the automatic oven art. The controller 30 stores data, such as default cooking parameters, the manually input cooking parameters, and the automated cooking programs, receives input from the control panel 28, and sends output to the control panel 28 for displaying a status of the oven 10 or otherwise communicating with the baker. Additionally, the controller 30 includes a timer 32 for tracking time during the manual and automated cooking programs and a cooling fan 34 located in the cabinet 12 for drawing cooling air into the cabinet 12 and directing the air toward the controller 30 to avoid overheating of the controller 30 by heat conducted from the cavity 14. The cooling air flows around the outside of the cooking cavity walls 16, 18, 20, 22, 23.

With continued reference to FIG. 2, the oven 10 further comprises a heating system 35 having an upper heating element 36, commonly referred to as a broiler, and a lower heating element 38. The schematic illustration of the FIG. 2 shows the lower heating element 38 as being hidden or mounted beneath the cooking cavity bottom wall 22 in a heating element housing 40. Heat from the lower heating element 38 conducts through the bottom wall 22 and into the cavity 14. Alternatively, the lower heating element 38 can be mounted inside the cavity 14, as is well-known in the oven art. Further, the upper and lower heating elements 36, 38 can be mounted at the side walls 16, 18 of the cavity 14, as disclosed in U.S. Pat. No. 6,545,251 to Allera et al., which is incorporated herein by reference in its entirety. The heating system 35 according to the illustrated embodiment further comprises a convection fan 42 that circulates air and steam, when present, within the cavity 14. The convection fan 42 can be any suitable fan and can be mounted in any suitable location of the cavity 14, such as in the rear wall 23.

In addition to the heating system, the oven 10 comprises a steam system 44 preferably mounted within the cabinet 12 and configured to introduce steam into the cavity 14. The steam system 44 in the illustrated embodiment comprises a boiler 46 that heats water stored in the steam system 44. However, the steam system 44 can be any suitable system that is capable of introducing steam directly into the cavity 14 or introducing water that is turned into steam in the cavity 14 and is not limited to the system shown schematically in FIG. 2.

Figure 3:
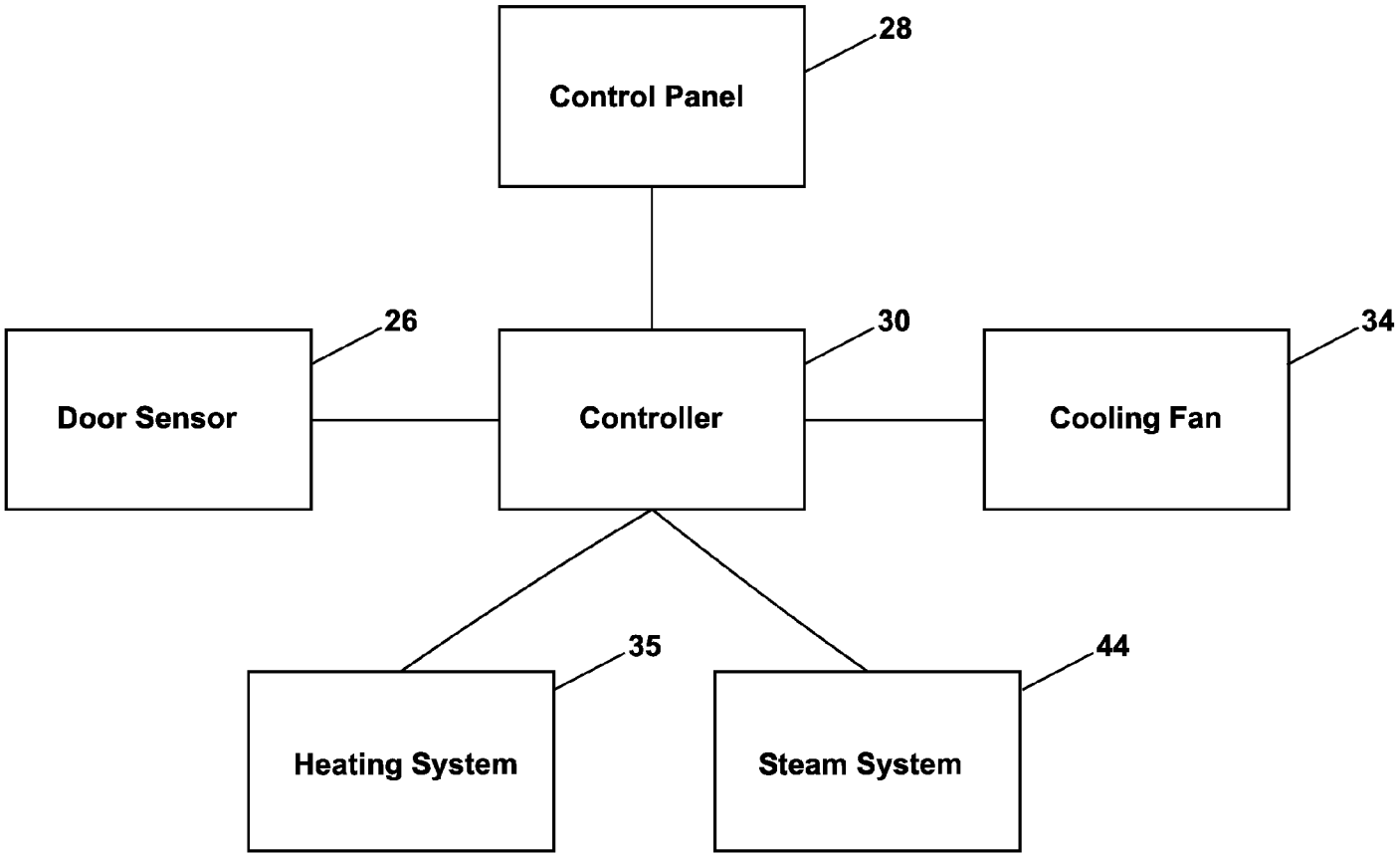
FIG. 3 is a schematic diagram illustrating a controller of the oven of the FIG. 1 and exemplary components in operative communication with the controller for executing a method of cooking vegetables according to one embodiment of the invention.

FIG. 3 is a block diagram that schematically illustrates a control system of the oven 10. The control system comprises the controller 30, which operably communicates with the control panel 28, as described above, the door sensor 26, the cooling fan 34, the heating system 35, and the steam system 44. The door sensor 26 communicates to the controller 30 the open or closed position of the door 24, and the controller 30 communicates with the cooling fan 34 to activate or deactivate the cooling fan 34 to control the temperature of the controller 30. The controller 30 instructs the heating system 35 to activate or deactivate the upper heating element 36, the lower heating element 38, and the convection fan 42, either all together, individually, or in groups, and provides instructions regarding the desired temperature of the cavity 14 and the rate at which the heating system 35 heats the cavity 14. Similarly, the controller 30 instructs the steam system 44 to activate or deactivate the boiler 46 and provides instructions regarding the desired temperature of the water in the steam system 44 in order to achieve the desired relative humidity in the cavity 14.

The relative humidity within the cooking cavity 14 is controlled by operating the steam system 44 at a given duty cycle. The relative humidity can be quantified by comparing a wet bulb temperature and a dry bulb temperature. The greater the difference between the dry and wet bulb temperatures, the lower the relative humidity. The dry bulb temperature is the temperature of the air in the cooking chamber measured using a thermometer unaffected by moisture in the air. The wet bulb temperature is the temperature of the air in the cooking chamber measured using a thermometer affected by moisture in the air. The wet bulb temperature measured at any time will always be less than the temperature measured by the dry bulb, and the difference between the wet bulb temperature and the dry bulb temperature at a given point during the cooking process is represented by the variable delta. Less relative humidity results in a greater difference between the dry bulb and wet bulb temperatures because the wet bulb is colder. Thus, delta increases as the relative humidity decreases.

For example, at an 80% duty cycle with a dry bulb temperature of approximately 375° F., the wet bulb temperature is approximately 195° F., and delta is approximately 180° F. At a 100% duty cycle with a dry bulb temperature of approximately 375° F., the wet bulb temperature is approximately 205° F., and delta is approximately 170° F. Thus, the relative humidity at a 100% duty cycle is greater than that at an 80% duty cycle because the value of delta is less during the 100% duty cycle.

The exemplary oven 10 can be used to implement a method 50 of roasting vegetables with steam according to one embodiment of the invention. The method 50 comprises several stages during which the heating system 35 operates to control a temperature of the cavity 14 and the steam system 44 operates to control a relative humidity of the cavity 14. The temperature and the relative humidity during the stages are selected to produce vegetables having desired outer and inner characteristics, such as texture, color, taste, and doneness. The doneness of the vegetables can correspond to the degree of crispiness of the vegetables. As used herein, the term "vegetables" refers to any plant of the vegetable kingdom used for food. Examples of vegetables include, but are not limited to, asparagus, carrots, potatoes, onions, cauliflower, eggplant, peppers, zucchini, leeks, broccoli, brussel sprouts, artichokes, peas, and the like.

Figure 4:
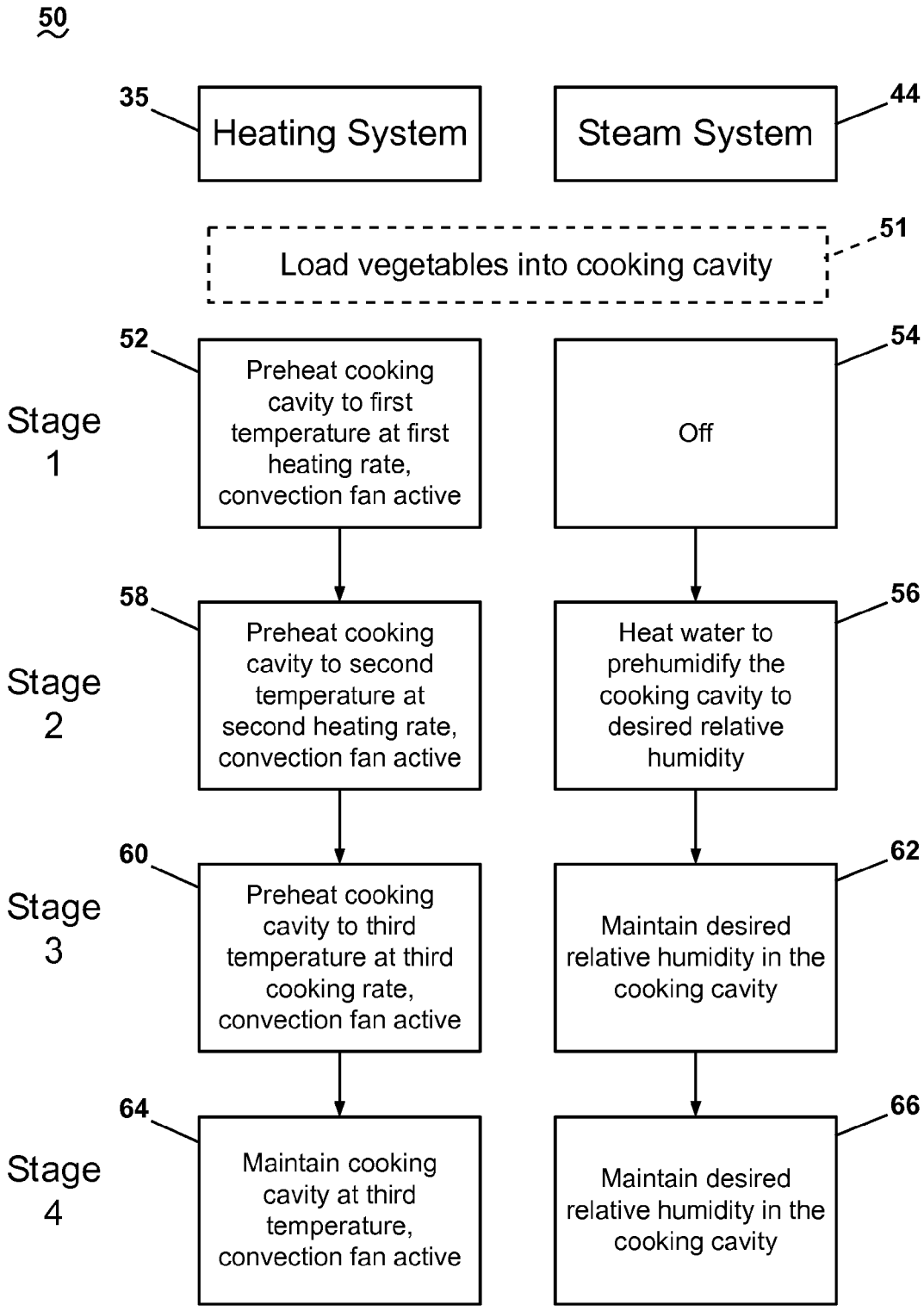
FIG. 4 is a schematic diagram illustrating a method of roasting vegetables according to one embodiment of the invention.
Figure 5:
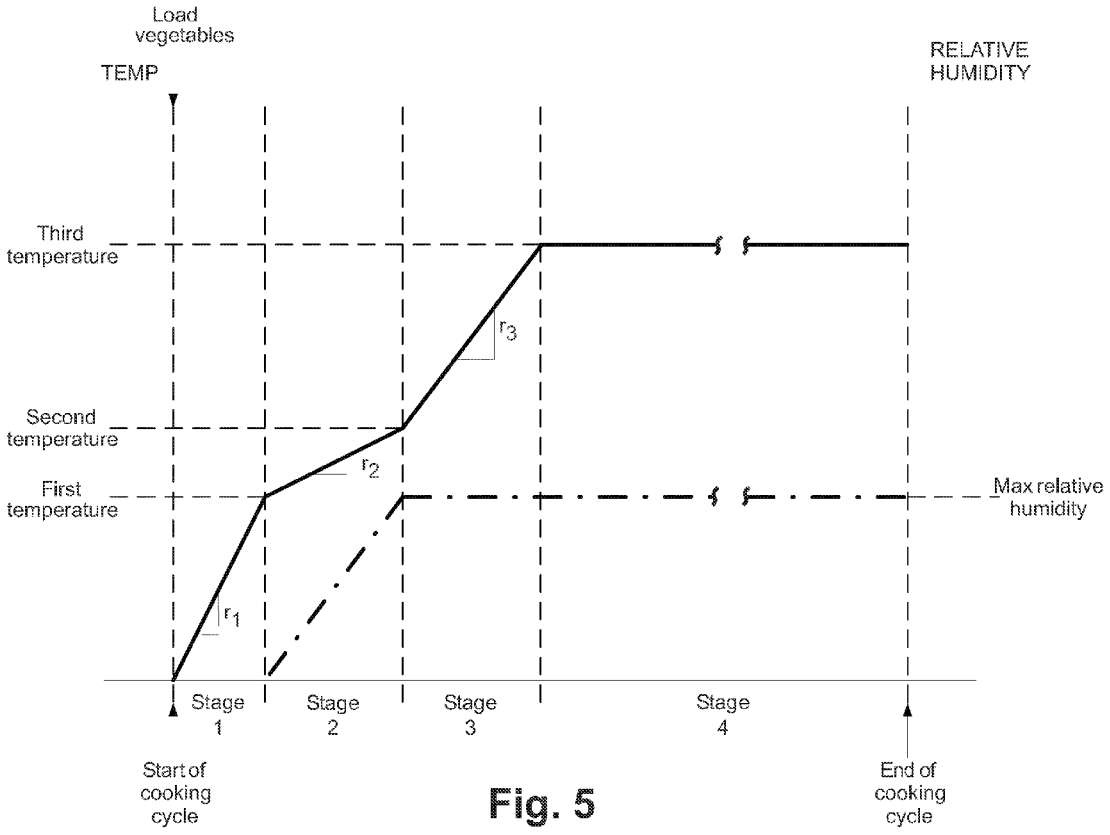
FIG. 5 is a schematic graph illustrating a temperature and a relative humidity in a cooking cavity of the oven of FIG. 1 during the execution of the method of roasting vegetables shown in FIG. 4.

The stages of the method 50 of roasting vegetables according to one embodiment of the invention is shown in a flow chart in FIG. 4, which presents the functions of the heating system 35 and the steam system 44 during each stage of the method 50. The corresponding temperature of the cavity 14 and the relative humidity of the cavity 14 for the stages of the method 50 are schematically illustrated in FIG. 5. FIG. 5 is not intended to report actual behavior of the temperature and the relative humidity during the method 50; rather, FIG. 5 represents a general behavior of these properties. It will be apparent to one of ordinary skill in the oven art that, in reality, the actual temperature and the actual relative humidity fluctuate about a target temperature and a target relative humidity during the operation of an oven.

Before the first stage of the method 50, the user prepares the vegetables and places the vegetables and a corresponding vegetables support, such as a baking stone or a roasting tray, if used, into the cavity 14, as indicated by step 51 in FIG. 4. In general, stage 1 can be referred to as a dry preheat stage where the heating system 35 heats the cavity 14 to a first temperature at a first heating rate $r_1$ (step 52), and the steam system 44 is off or not activated (step 54). The dry preheat stage raises the temperature of all exposed surfaces in the oven 10 to a level sufficient for preventing steam from condensing. According to one embodiment of the invention, the first temperature is a temperature about equal to the boiling point of water for the given environmental conditions, which is about 100° C. at standard temperature and pressure (STP). The desired first temperature is at least equal to about the boiling point of water so that steam entering the cavity 14 during stage 2 will maintain a vapor phase (or water entering the cavity 14 will undergo a phase change to vapor, if the steam system 44 introduces water into the cavity 14). The first heating rate is relatively high so as to flash heat the cavity 14 whereby the cavity 14 quickly reaches the first temperature. Flash heating comprises heating the cavity 14 rapidly, such as by heating the cavity 14 as fast as possible or at a rate to minimize the time required for the cavity 14 to reach the first temperature. Stage 1 terminates when the cavity 14 reaches the first temperature or after a predetermined period of time. Waiting until the end of stage 1 to initiate the steam system 44 ensures that the temperature of the cavity 14 is high enough to sustain steam in a vaporized state. As a result, the vapor will not condense in the cavity 14 and form water droplets on the walls 16, 18, 20, 22, 23, the vegetables, or any other items in the cavity 14. Formation of water droplets on porcelain, which is a material found on the cavity walls 16, 18, 20, 22, 23 of many ovens, can undesirably damage or stain the material.

Stage 2 follows stage 1 and can be generally referred to as a prehumidify stage where the steam system 44 activates to heat the water, such as by the boiler 46, to prehumidify the cavity 14 (step 56) while the heating system 35 continues to preheat the cavity 14. Stage 2 is designed to uniformly heat the vegetables and the interior of the oven 10 in order to prevent uneven cooking of the vegetables. When the water in the steam system 44 reaches its boiling point, the steam begins to enter the cavity 14 and raises the relative humidity in the cavity 14. According to one embodiment of the invention, the relative humidity of the cavity 14 reaches a desired relative humidity during stage 2 or at least by the end of stage 2. Thus, by the end of stage, 2, the cavity 14 is moist, a condition where the relative humidity of the cavity 14 is at a level desired for initial roasting of the vegetables. Concurrently, the heating system 35 raises the temperature of the cavity 14 to a second temperature at a second heating rate $r_2$ less than the first heating rate (step 58). According to one embodiment of the invention, the second temperature is just below a minimum desired steam roasting temperature. The second heating rate is relatively low so that the temperature of the cavity 14 slowly approaches the second temperature to avoid exposing the vegetables to excessive direct radiation and to ensure that the cavity 14 is uniformly heated. The term "uniformly heated" refers to all spaces and walls 16, 18, 20, 22, 23 of the cavity 14 and items, such as baking racks, baking stones, and roasting trays, in the cavity 14 achieving the first temperature. A uniformly heated cavity results in a higher quality vegetables item with consistent final characteristics. When the cavity 14 is uniformly heated and the baker opens and closes the door 24, the temperature of the cavity 14 almost immediately returns to the temperature of the cavity 14 prior to the opening of the door 24.

When stage 2 ends, either upon the cavity 14 reaching a desired relative humidity, or the second temperature, or after a predetermined period of time, stage 3 begins. During stage 3, the heating system 35 increases the temperature of the cavity 14 to a third temperature (step 60) at a third heating rate $r_3$ optionally greater than the second heating rate and less than the first heating rate, and the steam system 44 maintains the desired relative humidity (step 62). According to one embodiment of the invention, the third temperature is equal to a set temperature, which can be a temperature entered by a user through a user interface on the control panel 28 or set by the automatic cooking program, and is at least equal to the minimum desired steam roasting temperature. The user interface can comprise, for example, a button, a touch pad, a touch screen, or a voice command unit. Stage 3 is used to heat the oven to the proper cooking temperature so that the vegetables can be properly cooked during stage 4.

When the temperature of the cavity 14 reaches the third temperature or after a predetermined period of time, stage 4 begins. During stage 4, the temperature in the cooking cavity is maintained at the third temperature and steam is introduced to maintain the desired relative humidity. The convection fan 42 is active during stage 4 and the preceding stages to help distribute the air and steam throughout the cavity 14. The duration of stage 4 can be variable and dependent on a user input cooking cycle time. In this circumstance, the duration of stage 4 is equal to the user input cycle time less the combined duration of stages 1-3. If the user input cycle time is less than the combined duration of stages 1-3, stage 4 can be eliminated, and the duration of stage 3 can be adjusted in accordance with the user input cycle time. Alternatively, the duration of stage 4 can be set by an automatic cooking cycle.

An exemplary implementation of the method 50 with the oven 10 described above, along with exemplary operational parameter values, is presented below, with it being understood that the method 50 can be utilized with any suitable household oven 10 and that the implementation of the method 50 with different ovens can differ according to the oven utilized. The exemplary operational parameter values are shown in a table in FIG. 6.

During stage 1, the heating system 35 rapidly heats the cavity 14 to about 212° F., the boiling point of water at sea level. As is well known in the chemistry art, the boiling point of water changes with pressure and solute content, and the first temperature can be adjusted accordingly. The duration of stage 1 is about 4 minutes; thus, the first heating rate has an average rate of about 35° F. per minute if the cavity 14 reaches the 212° F. at the end of the 4 minutes. However, it is possible for the cavity 14 can reach the first temperature before the end of the 4 minutes, if desired. To control the rate of heating, the controller 30 instructs the heating system 35 to operate at a predetermined duty cycle. For the heating elements in the exemplary heating system, the upper heating element 36 is operated at a 65% duty cycle and the lower heating element 38 at a 100% duty cycle and to activate the convection fan 42. An exemplary duty cycle is the percentage of time the heating element is on (i.e., power is supplied to the heating element) during a certain time interval, such as 1 minute. The duty cycle of the upper heating element 36 is lower than that of the lower heating element 38 to avoid overheating and excessively browning the exposed upper surface of the vegetables that is already present in the cavity 14.

It should be noted that the described duty cycles are dependent on the wattage of the heating elements 36, 38 and the supplied current. For the above example, the upper heating element is 3250 watts, the lower heating element is 2000 watts, and the current is anticipated 115 volts at 15 amps. However, the actual supplied current may vary from the anticipated or design value. Thus, the specific duty cycle values will vary for different configurations.

After the 4 minutes, stage 2 begins, and the controller 30 instructs the heating system 35 to reduce the duty cycles of the upper and lower heating elements 36, 38 to 35% and 65% duty cycles, respectively, to slowly increase the temperature to about 250° F. The duration of stage 2 is about 6 minutes; thus, the average for the second heating rate is about 6° F. per minute if the temperature of cavity 14 reaches about 250° F. at the end of the 6 minutes. As with stage 1, the temperature in the cavity 14 can reach the second temperature prior to the end of the 6 minutes, if desired. Additionally, the steam system 44 communicates with the controller 30 and turns on the boiler 46 for operation at an 80% for roasted, 100% for steamed affect duty cycle to raise the relative humidity in the cavity 14. As with the heating elements 36, 38, an exemplary duty cycle for the boiler 46 is the percentage of time the boiler 46 is on (i.e., power is supplied to the boiler 46) during a certain time interval, such as 1 minute.

During stage 3, the duty cycles of the upper and lower heating elements 36, 38 remain the same as in stage 2 while increasing the temperature of the cavity 14 to the third temperature, which, according to one embodiment of the invention, is a set temperature. The set temperature is a temperature at which the vegetables are roasted following the preheating and usually ranges between about 300° F., the minimum desired steam roasting temperature according to one embodiment of the invention, and about 450° F. The second temperature from stage 2 can be adjusted accordingly if the minimum desired steam roasting temperature differs from about 300° F. The duration of stage 3 is about 6 minutes, and the cavity 14 can reach the set temperature before the end of the 6 minutes and at least by the end of the 6 minutes. Further, the duty cycle of the boiler 46 remains at 80%.

Following stage 3, the controller initiates stage 4, which has a variable duration that depends on the user input cooking cycle time, as described above. During stage 4, the duty cycles of the upper and lower heating elements 36, 38 remain the same to maintain the temperature of the cavity 14 at the set temperature. Further, the controller 30 maintains the 80% duty cycle of the boiler 46.

The exemplary oven 10 can also be used to implement a method 150 of steaming vegetables with steam according to another embodiment of the invention. The method 150 comprises several stages during which the heating system 35 operates to control a temperature of the cavity 14 and the steam system 44 operates to control a relative humidity of the cavity 14. The temperature and the relative humidity during the stages are selected to produce vegetables having desired outer and inner characteristics, such as texture, color, taste, and doneness. The doneness of the vegetables can correspond to the degree of crispiness of the vegetables. As used herein, the term "vegetables" refers to any plant of the vegetable kingdom used for food. Examples of vegetables include, but are not limited to, asparagus, carrots, potatoes, onions, cauliflower, eggplant, peppers, zucchini, leeks, broccoli, brussel sprouts, artichokes, peas, and the like.

Figure 7:
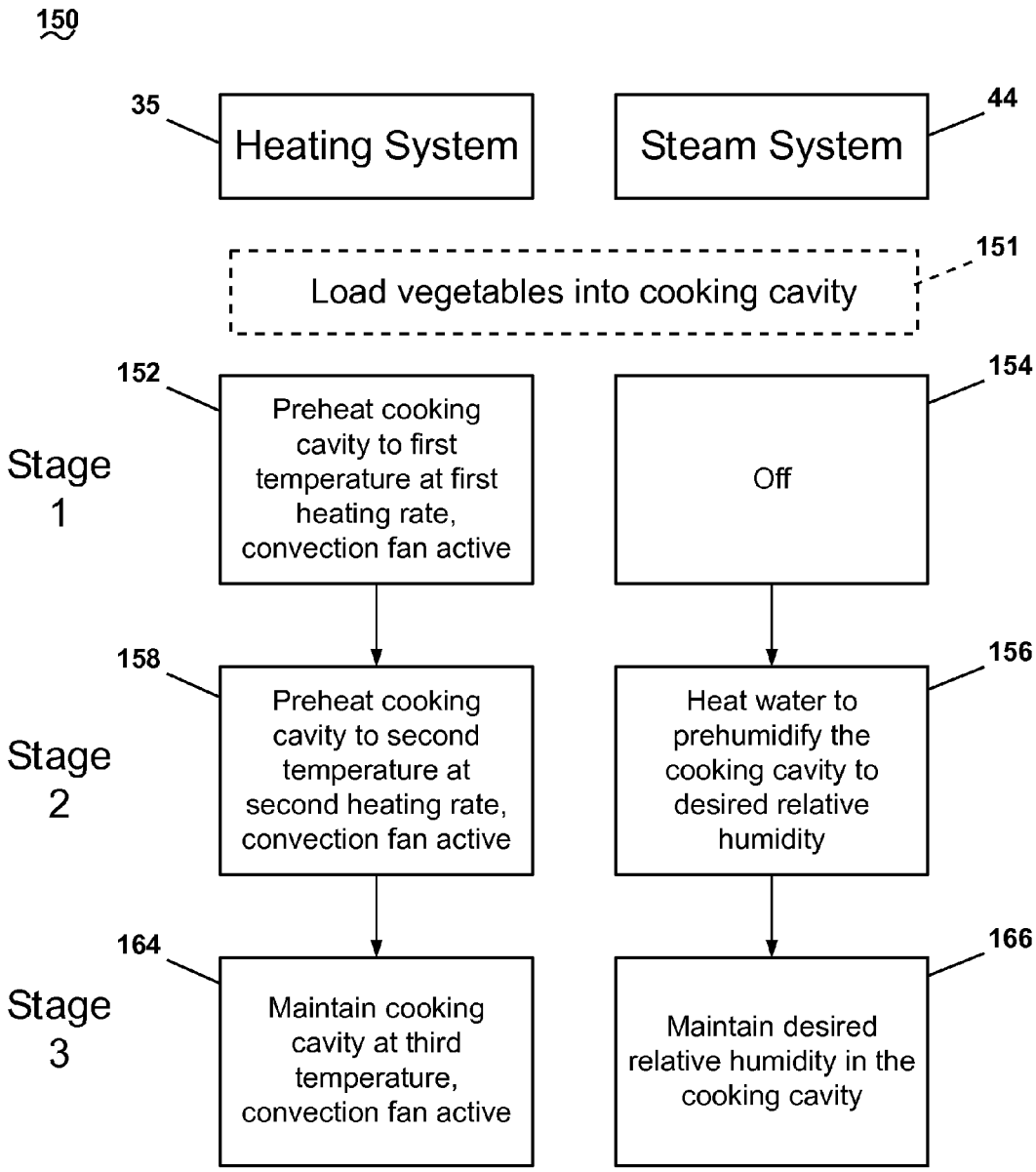
FIG. 7 is a schematic diagram illustrating a method of steaming vegetables according to a second embodiment of the invention.
Figure 8:
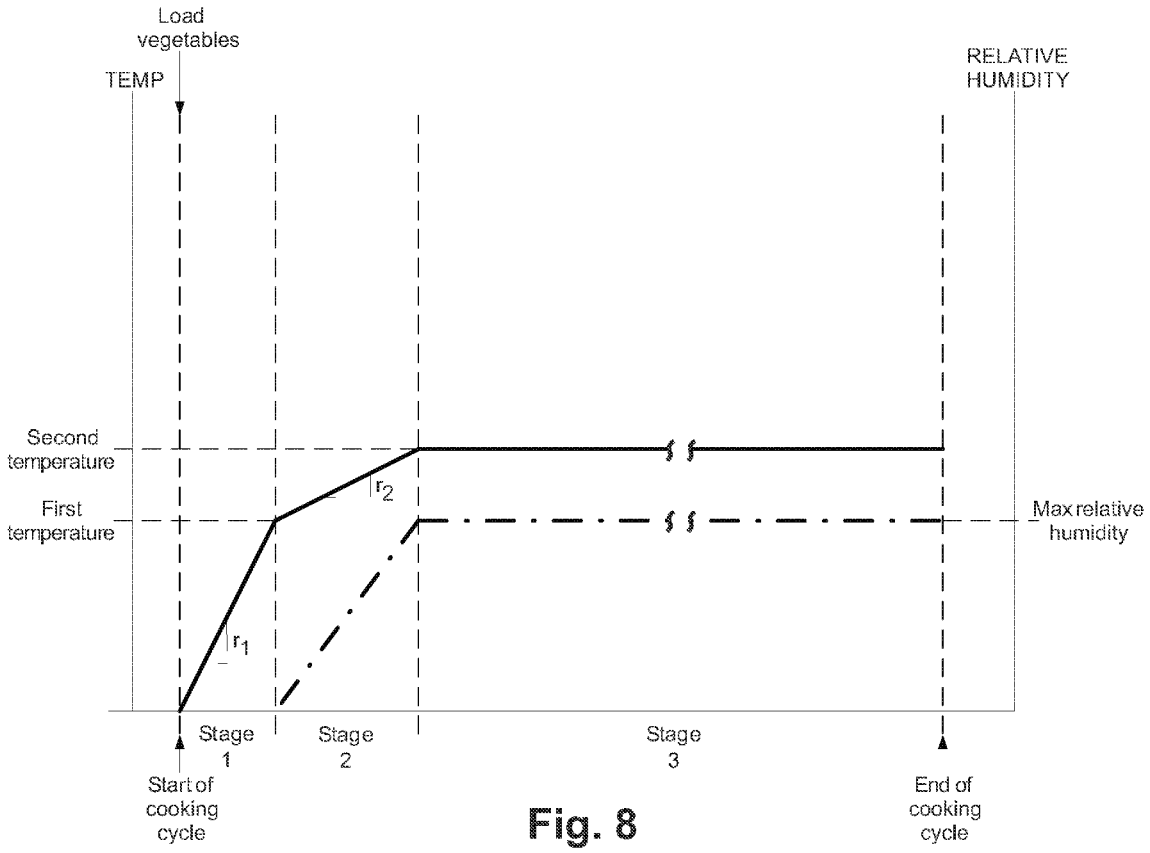
FIG. 8 is a schematic graph illustrating a temperature and a relative humidity in a cooking cavity of the oven of FIG. 1 during the execution of the method of steaming vegetables shown in FIG. 7.

The stages of the method 150 of steaming vegetables according to one embodiment of the invention is shown in a flow chart in FIG. 7, which presents the functions of the heating system 35 and the steam system 44 during each stage of the method 150. The corresponding temperature of the cavity 14 and the relative humidity of the cavity 14 for the stages of the method 150 are schematically illustrated in FIG. 8. FIG. 8 is not intended to report actual behavior of the temperature and the relative humidity during the method 150; rather, FIG. 8 represents a general behavior of these properties. It will be apparent to one of ordinary skill in the oven art that, in reality, the actual temperature and the actual relative humidity fluctuate about a target temperature and a target relative humidity during the operation of an oven.

Stages 1 and 2 of the method 150 are nearly identical to stages 1 and 2 of the method 50. The only difference is that in stage 2, the duty cycle of the boiler 46 is 100% in the method 150 as compared to the 80% duty cycle of the boiler 46 in the method 50. During stage 1 of the method 150, the heating system 35 heats the cavity 14 to a first temperature at a first heating rate $r_1$ (step 152), and the steam system 44 is off or not activated (step 154). This is intended to prevent condensation of the steam during stage 2. During stage 2 of the method 150, the steam system 44 activates to heat the water, such as by the boiler 46, to prehumidify the cavity 14 (step 156) while the heating system 35 raises the temperature of the cavity 14 to a second temperature at a second heating rate $r_2$ less than the first heating rate (step 158) in order to uniformly heat the vegetables and bring the vegetables up to cooking temperature.

When stage 2 ends, either upon the cavity 14 reaching a desired relative humidity, or the second temperature, or after a predetermined period of time, stage 3 begins. Stage 3 is used to cook the vegetables. Operationally, stages 2 and 3 are substantially identical in that the heating system 35 maintains the cavity 14 at the second temperature while the steam system 44 continues to maintain steam production. The convection fan 42 is active during this stage and the preceding stages to help distribute the air and steam throughout the cavity 14. The duration of stage 3 can be variable and dependent on a user input cooking cycle time. In this circumstance, the duration of stage 3 is equal to the user input cycle time less the combined duration of stages 1 and 2. If the user input cycle time is less than the combined duration of stages 1-2, stage 3 can be eliminated, and the duration of stage 2 can be adjusted in accordance with the user input cycle time. Alternatively, the duration of stage 3 can be set by an automatic cooking cycle.

An exemplary implementation of the method 150 with the oven 10 described above, along with exemplary operational parameter values, is presented below, with it being understood that the method 150 can be utilized with any suitable household oven 10 and that the implementation of the method 150 with different ovens can differ according to the oven utilized. The exemplary operational parameter values are shown in a table in FIG. 9.

During stage 1, the heating system 35 rapidly heats the cavity 14 to about 212° F., the boiling point of water at sea level. As is well known in the chemistry art, the boiling point of water changes with altitude and solute content, and the first temperature can be adjusted accordingly. The duration of stage 1 is about 4 minutes; thus, the first heating rate is about 35° F. per minute if the cavity 14 reaches the 212° F. at the end of the 4 minutes. However, the cavity 14 can reach the first temperature before the end of the 4 minutes, if desired. The controller 30 instructs the heating system 35 to operate the upper heating element 36 at a 65% duty cycle and the lower heating element 38 at a 100% duty cycle and to activate the convection fan 42. An exemplary duty cycle is the percentage of time the heating element is on (i.e., power is supplied to the heating element) during a certain time interval, such as 1 minute. The duty cycle of the upper heating element 36 is lower than that of the lower heating element 38 to avoid overheating and excessively browning the exposed upper surface of the vegetables that is already present in the cavity 14.

After the 4 minutes, stage 2 begins, and the controller 30 instructs the heating system 35 to reduce the duty cycles of the upper and lower heating elements 36, 38 to 35% and 65% duty cycles, respectively, to slowly increase the temperature to about 250° F. The duration of stage 2 is about 6 minutes; thus, the first heating rate is about 6° F. per minute if the temperature of cavity 14 reaches about 250° F. at the end of the 6 minutes. As with stage 1, the temperature in the cavity 14 can reach the second temperature prior to the end of the 6 minutes, if desired. Additionally, the steam system 44 communicates with the controller 30 and turns on the boiler 46 for operation at a 100% duty cycle to raise the relative humidity in the cavity 14 to the desired relative humidity. As with the heating elements 36, 38, an exemplary duty cycle for the boiler 46 is the percentage of time the boiler 46 is on (i.e., power is supplied to the boiler 46) during a certain time interval, such as 1 minute.

Following stage 2, the controller initiates stage 3, which has a variable duration that depends on the user input cooking cycle time, as described above. During stage 3, the duty cycles of the upper and lower heating elements 36, 38 remain the same to maintain the temperature of the cavity 14 at the set temperature. Further, the controller 30 maintains the 100% duty cycle of the boiler 46. Operationally, there are no differences between stage 2 and stage 3.

As mentioned above, the operational parameter values shown in FIGS. 6 and 9 are dependent on the oven 10 utilized to implement the method 50, 150, respectively. Different ovens have different types of heating systems (e.g., some ovens do not have the convection fan 42) and steam systems, which affect the implementation of the methods 50, 150. For example, the above operational parameter values were determined with the cooling fan 34 operational during the entire cooking cycle. Because the cooling fan can draw away heat from the cooking cavity 14 though the cooking cavity walls 16, 18, 20, 22, 23, the cooling fan can affect the temperature of the cavity 14.

When the baker desires to roast vegetables using the method 50 or steam vegetables using the method 150, the baker prepares the vegetables, opens the door 24, places the vegetables along with the vegetables support, if used, in the cavity 14, and closes the door 24. Next, the user selects a "ROASTED VEGETABLES" cooking cycle or a "STEAMED VEGETABLES" cooking cycle on the oven 10 through the control panel 28. The baker also enters the set temperature and the cooking cycle time, if needed, through the control panel 28. The oven 10 then implements the method 50, beginning at stage 1 and ending at stage 3 or stage 4, or the method 150, beginning at stage 1 and ending at stage 2 or stage 3. Following the last stage, the baker removes the vegetables, which have the desired outer and inner characteristics, such as texture and color, from the cavity 14. The greater duty cycle of the boiler 46 during the method 150 for steaming vegetables in combination with a typically shorter total cooking time and a lower cooking temperature is designed to keep the vegetables thoroughly moistened throughout the cooking process in order to prevent browning. The slightly higher cooking temperatures used in the method 50 for roasting vegetables along with the reduced duty cycle of the boiler 46 and the typically longer cooking time ensure that the vegetables are roasted to a crisp exterior while maintaining moisture internally. Thus, the vegetables are roasted or steamed in a controlled steam environment, and the baker does not have to attend to the vegetables during the roasting or steaming process, nor execute any dangerous home remedies to introduce steam into the cavity 14.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of operating an oven with a cooking cavity during a cooking cycle using steam, a heating system for heating the cooking cavity, and a steam system for introducing steam into the cooking cavity, the method comprising:

a first heating step comprising preheating the cooking cavity to a first temperature;

a second heating step comprising preheating the cooking cavity from the first temperature to a second temperature;

a third heating step of heating the cooking cavity to a cooking temperature;

operating the steam system at a given duty cycle to introduce steam into the cooking cavity during the second heating step to increase a relative humidity in the cooking cavity to a predetermined level; and maintaining the cooking cavity at the cooking temperature while operating the steam system at the given duty cycle to maintain the relative humidity at the predetermined level until completion of the cooking cycle.

2. The method according to claim 1, wherein the first heating step is conducted at a first heating rate, and the second heating step is conducted at a second heating rate, which is less than the first heating rate.

3. The method according to claim 2, wherein the first heating rate is about 35° F. per minute.

4. The method according to claim 3, wherein the second heating rate is about 6° F/minute.

5. The method according to claim 1, wherein the first temperature is at least the boiling point of water.

6. The method according to claim 5, wherein the second temperature is about 250° F.

7. The method according to claim 1, wherein the cooking temperature is different from the second temperature, and further comprising a fourth heating step to heat the cooking cavity to the cooking temperature from the second temperature.

8. The method according to claim 7, wherein the cooking temperature is input by a user into a control panel of the oven.

9. The method according to claim 7 wherein the fourth heating step has a variable duration depending on a user input cooking cycle time.

10. The method according to claim 1 wherein a level of relative humidity of the cooking cavity is sufficient for roasting vegetables.

11. The method according to claim 1 wherein a level of relative humidity of the cooking cavity is sufficient for steaming vegetables.

12. The method according to claim 1, wherein the heating system generates a greater output during the first heating step than during the second heating step.

13. The method according to claim 1, wherein the steam system is operated to maintain a lower relative humidity in the cooking cavity when vegetables are roasted than when vegetables are steamed.

14. The method according to claim 1, wherein the first heating step comprises a flash heating step where the heating system generates a greater output than during the second heating step.

15. The method according to claim 14, wherein during the flash heating step, the heating system operates at least one of a top heating element and a bottom heating element at 100% duty cycle.

16. The method according to claim 14, wherein a rate of heating of the first heating step is greater than a rate of heating for the second heating step.

17. The method according to claim 1, wherein the second heating step uniformly heats the cooking cavity.

18. The method according to claim 1, wherein the second temperature is the cooking temperature and the second heating step and the third heating step occur simultaneously.

* * * * *